US010944144B2

(12) United States Patent
Kettunen

(10) Patent No.: US 10,944,144 B2
(45) Date of Patent: Mar. 9, 2021

(54) LOW LOSS RADIO FREQUENCY TRANSMISSION LINES AND DEVICES INCLUDING SUCH TRANSMISSION LINES

(71) Applicant: CommScope Italy S.r.l., Agrate Brianza (IT)

(72) Inventor: Kimmo Henrik Olavi Kettunen, Oulu (FI)

(73) Assignee: CommScope Italy, S.R.L., Agrate Brianza (IT)

( * ) Notice: Subject to any disclaimer, the term of this patent is extended or adjusted under 35 U.S.C. 154(b) by 91 days.

(21) Appl. No.: 16/281,146

(22) Filed: Feb. 21, 2019

(65) Prior Publication Data

US 2019/0296415 A1 Sep. 26, 2019

Related U.S. Application Data

(60) Provisional application No. 62/645,238, filed on Mar. 20, 2018.

(51) Int. Cl.
*H01P 3/08* (2006.01)
*H01P 1/203* (2006.01)

(52) U.S. Cl.
CPC ..... *H01P 3/084* (2013.01); *H01P 1/203* (2013.01); *H01P 3/08* (2013.01)

(58) Field of Classification Search
CPC ..... H01P 3/084; H01P 3/08; H01P 1/203
USPC ..... 333/204, 205, 238
See application file for complete search history.

(56) References Cited

U.S. PATENT DOCUMENTS 5,072,201 A * 12/1991 Devaux ..... H01P 3/085 174/117 AS
5,675,302 A * 10/1997 Howard ..... H01P 1/047 333/243
2005/0190019 A1* 9/2005 Metz ..... H01P 3/084 333/238
2015/0042419 A1* 2/2015 Cho ..... H01P 1/2082 333/204

OTHER PUBLICATIONS

Data Sheet for Properties of PREPERM Grades, 2 pages, www.preperm.com (Admitted Prior Art).

* cited by examiner

*Primary Examiner* — Rakesh B Patel
(74) *Attorney, Agent, or Firm* — Myers Bigel, P.A.

(57) ABSTRACT

RF transmission lines that include a conductive ground plane, a conductive strip that extends above the ground plane, one or more plastic strips disposed between the conductive ground plane and the conductive strip, the one or more plastic strips having a combined length that is at least half a length of the conductive strip, and a plurality of dielectric fasteners that maintain the conductive strip at a predetermined distance above the conductive ground plane.

23 Claims, 8 Drawing Sheets

LOW LOSS RADIO FREQUENCY TRANSMISSION LINES AND DEVICES INCLUDING SUCH TRANSMISSION LINES

CROSS-REFERENCE TO RELATED APPLICATION

The present application claims priority under 35 U.S.C. § 119 to U.S. Provisional Patent Application Ser. No. 62/645,238, filed Mar. 20, 2018, the entire content of which is incorporated herein by reference as if set forth in its entirety.

BACKGROUND

The present invention generally relates to radio frequency ("RF") communications and, more particularly, to transmission lines for carrying RF signals.

Wireless communications systems are in wide use for various applications such as cellular communications, satellite communications and the like. These wireless communications systems typically transmit and receive RF signals using antennas over an air interface. While the air interface is a wireless interface, physical transmission lines are typically used to connect an RF source (e.g., a radio) to the transmit antenna and to connect a receive antenna to an RF receiver. These transmission line structures are typically referred to as RF transmission lines. RF transmission lines are also used in a wide variety of "wired" communications applications.

A wide variety of RF transmission lines are known in the art. One commonly used RF transmission line is the microstrip transmission line. A microstrip transmission line includes a conductive strip that is separated from a conductive ground plane by a dielectric medium. The dielectric medium may comprise, for example, a dielectric substrate or an air gap. Microstrip transmission lines are often implemented using printed circuit board technology, with a conductive ground plane formed on one side of a dielectric substrate of the printed circuit board and a conductive strip or "trace" formed on the other side of the dielectric substrate.

Another commonly used RF transmission line is the so-called stripline transmission line. A stripline transmission line includes a conductive strip that is formed in a dielectric medium between a pair of parallel ground planes. The dielectric medium, which may comprise a single dielectric medium (e.g., an air gap) or multiple dielectric mediums (e.g., a pair of dielectric substrates or the combination of an air gap and dielectric spacers) separates the conductive strip from the ground planes. A microstrip transmission line having a conductive strip that is separated from a first ground plane by a first dielectric substrate may be converted into a stripline transmission line by sequentially stacking a second dielectric substrate and a second ground plane on the conductive strip opposite the first dielectric substrate and the first ground plane.

Microstrip transmission lines are cheaper and simpler to manufacture than stripline transmission lines, but also radiate more energy than stripline transmission lines. Microstrip and stripline transmission lines that use air gaps as the dielectric medium are typically referred to "air-insulated" microstrip and stripline transmission lines. Air-insulated microstrip and stripline transmission lines typically include dielectric spacers that are interposed between the conductive strip and the conductive ground plane(s) to ensure that a consistent gap is maintained between the conductive strip and the conductive ground planes.

SUMMARY

Pursuant to embodiments of the present invention, RF transmission lines are provided that include a conductive ground plane, a conductive strip that extends above the ground plane, one or more plastic strips disposed between the conductive ground plane and the conductive strip, the one or more plastic strips having a combined length that is at least half a length of the conductive strip, and a plurality of dielectric fasteners that maintain the conductive strip at a predetermined distance above the conductive ground plane.

In some embodiments, the dielectric fasteners may be dielectric screws. Each dielectric screw may extend through a respective opening in the conductive strip into a respective opening in the conductive ground plane. Each dielectric screw may further extend through a respective opening in the one or more plastic strips.

In some embodiments, the conductive strip may be separate from the one or more plastic strips, and the dielectric fasteners may capture the conductive strip between the one or more plastic strips and the conductive ground plane.

In some embodiments, a maximum width of the one or more plastic strips may exceed a maximum width of the conductive strip.

In some embodiments, the RF transmission line may further include a plastic cover strip that is on the conductive strip opposite the one or more plastic strips.

In some embodiments, the one or more plastic strips may be formed of a plastic material having a dielectric constant of at least 2.0. In one example embodiment, the one or more plastic strips are formed of a plastic material having a dielectric constant of at least 2.5 and a dissipation factor at 1 GHz of less than 0.001.

In some embodiments, the RF transmission line may be part of a filter that includes a filter housing, a first connector that extends through the filter housing, and a second connector that extends through the filter housing. The RF transmission line may, for example, electrically connect the first connector to the second connector, and the conductive ground plane of the RF transmission line may be a surface (e.g., the floor) of the filter housing. In some embodiments, the filter may further include a plurality of resonators within the filter housing, and a plastic material having a dielectric constant of at least 2.5 may be provided between top portions of at least some of the resonators and a filter cover that covers an opening in the filter housing.

Pursuant to further embodiments of the present invention, RF transmission lines are provided that include a conductive ground plane, a conductive strip that extends above the ground plane, a plastic strip disposed between the conductive ground plane and the conductive strip, the plastic strip being separate from the conductive strip. A length of the conductive strip in a first direction is greater than a width of the conductive strip in a second direction, and the width of the conductive strip in the second direction is greater than a thickness of the conductive strip in a third direction, the first second and third directions being perpendicular to each other. The plastic strip has a width in the second direction that is greater than the width of the conductive strip. Additionally, the plastic strip is formed of a plastic material having a dielectric constant of at least 2.5 and a dissipation factor at 1 GHz of less than 0.001.

In some embodiments, the RF transmission line may further include a plurality of dielectric fasteners that maintain the conductive strip at a predetermined distance above the conductive ground plane. The dielectric fasteners may be, for example, dielectric screws. In such embodiments, each dielectric screw may extend through a respective opening in the conductive strip into a respective opening in the conductive ground plane. Each dielectric screw may further extend through a respective opening in the plastic strip.

In some embodiments, the RF transmission line may further include a plastic cover strip that is on the conductive strip opposite the plastic strip. In such embodiments, the RF transmission line may also include a second ground plane on the plastic cover strip opposite the conductive strip to provide a stripline transmission structure. The stripline transmission line may further include a plurality of dielectric fasteners, where each dielectric fastener extends through the second ground plane, the plastic cover strip, the conductive strip, the plastic strip and into the conductive ground plane.

Pursuant to still further embodiments of the present invention, RF filters are provided that include a filter housing having a top opening, a filter cover that is dimensioned to cover the top opening, a first connector that extends through a first connector opening in the filter housing, a second connector that extends through a second connector opening in the filter housing, a plurality of resonators within the filter housing and an RF transmission line disposed on an RF transmission path that extends from the first connector to the second connector. The RF transmission line may comprise a conductive ground plane, a conductive strip disposed above the conductive ground plane, one or more plastic strips disposed between the conductive ground plane and the conductive strip, the one or more plastic strips having a combined length that is at least half a length of the conductive strip, and a plurality of dielectric fasteners that maintain the conductive strip at a predetermined distance above the conductive ground plane and that capture the one or more plastic strips between the ground plane and the conductive strip.

In some embodiments, the dielectric fasteners may comprise dielectric screws. At least some of the dielectric screws may extend through a respective opening in the conductive strip and through a respective opening in the one or more plastic strips into a respective opening in the conductive ground plane.

In some embodiments, a maximum width of the one or more plastic strips may exceed a maximum width of the conductive strip.

In some embodiments, the one or more plastic strips may be formed of a plastic material having a dielectric constant of at least 2.5 and a dissipation factor at 1 GHz of less than 0.001.

In some embodiments, the conductive ground plane may be a floor of the filter housing.

DETAILED DESCRIPTION

Figure 1:
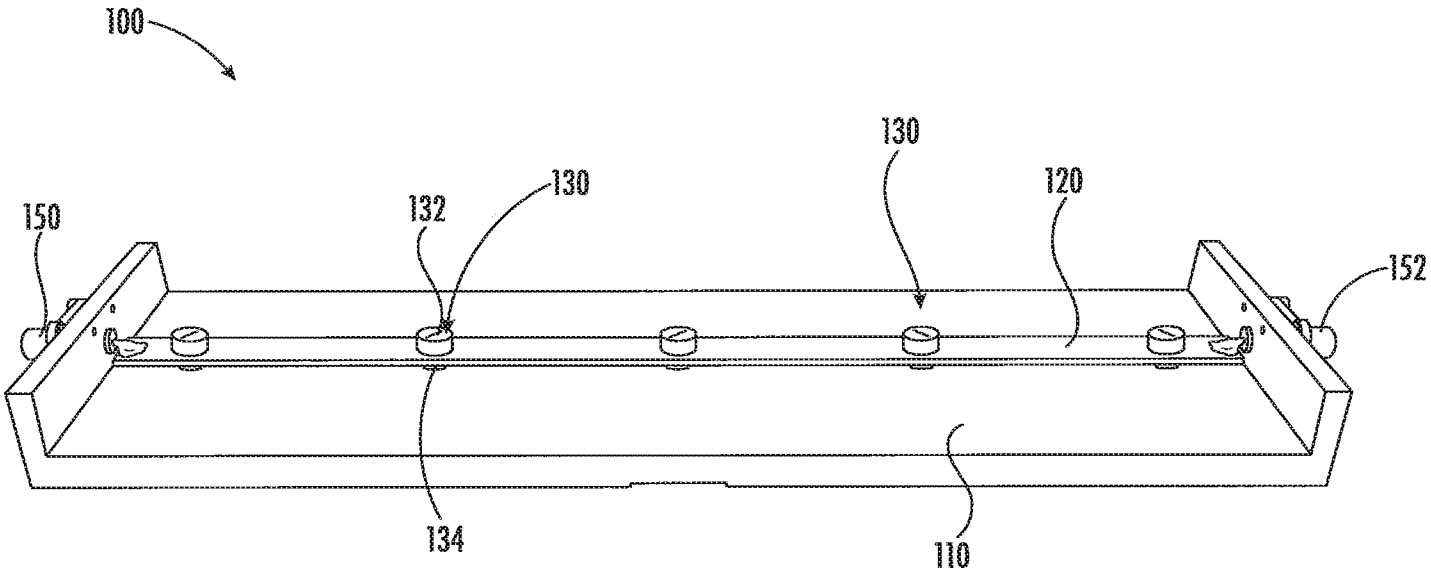
FIG. 1 (PRIOR ART)
FIG. 1 is a perspective view of a conventional air-insulated microstrip transmission line.

As discussed above, both printed circuit board-based microstrip transmission lines and air-insulated microstrip transmission lines are known in the art. Printed circuit board-based microstrip transmission lines are in wide use as they are easily fabricated and can readily be designed to have any desired shape. However, printed circuit board-based microstrip transmission lines may exhibit relatively high dielectric losses (since the dielectric materials used in standard printed circuit boards are typically formed of relatively lossy materials), and typically have relatively thin conductive traces which may have limited power handling capabilities and/or which may provide poor impedance matching with RF transmission structures (e.g., connectors, other transmission lines, etc.) that are connected at either end of the printed circuit board-based microstrip transmission line. While printed circuit boards can be fabricated to have thicker metal layers, these non-standard printed circuit boards may cost significantly more, and still may not have a sufficient thickness for impedance matching and/or power handling purposes. Additionally, the conductive patterns on the printed circuit board-based RF transmission line may be sources of passive intermodulation (PIM) distortion due to the relatively high surface roughness of the conductive patterns and/or sharp edges formed during the metal etching steps in the printed circuit board fabrication process. As such, printed circuit board-based microstrip RF transmission lines may not be well-suited for many applications.

Air-insulated microstrip transmission lines are often used in applications where printed circuit board-based microstrip transmission lines cannot provide adequate performance. With air-insulated microstrip transmission lines, the conductive strip may be formed by cutting or stamping a conductive strip from sheet metal, and hence thicker conductive strips may readily be provided that can readily handle higher current levels without damage to the RF transmission line and/or which can provide improved impedance matching. Additionally, providing a dielectric between the conductive ground plane and the conductive strip that is mostly air may result in very low dielectric loss levels. Additionally, sheet metal may be readily obtained that has very low levels of surface roughness, and can also be readily and inexpensively polished to further reduce surface roughness, thereby reducing or eliminating PIM distortion. However, air-insulated microstrip transmission lines may have relatively high impedances and hence may require longer physical lengths for impedance matching purposes.

Pursuant to embodiments of the present invention, microstrip and stripline transmission lines are provided that are formed using low-loss, high dielectric constant materials. The RF transmission lines according to embodiments of the present invention may achieve insertion loss and return loss performance comparable to conventional air-insulated microstrip transmission lines while achieving the same electrical length as such conventional RF transmission lines with a smaller physical length. The RF transmission lines according to embodiments of the present invention may be particularly well-suited for use in RF filters where impedance matching issues require lower impedance transmission lines or where transmission line segments may need to have a pre-specified electrical length. The use of the RF transmission lines according to embodiments of the present invention may allow for physically shorter RF transmission lines that have suitable impedances and/or that meet the electrical length requirements, allowing for a reduction in the physical size of the filters.

In some embodiments, PrePerm thermoplastic materials sold by Premix® may be used as the low-loss, high dielectric constant material. The RF transmission line may include a conductive ground plane, a conductive strip disposed above the ground plane, one or more plastic strips disposed between the conductive ground plane and the conductive strip, and a plurality of dielectric fasteners that maintain the conductive strip at a predetermined distance above the conductive ground plane. In some embodiments, the one or more plastic strips may have a combined length that is at least half a length of the conductive strip. In some cases, a single plastic strip may be provided that is provided underneath substantially the entire length of the conductive strip.

The dielectric fasteners may be dielectric screws in some embodiments. Each dielectric screw may extend through a respective opening in the conductive strip into a respective opening in the conductive ground plane. Each dielectric screw may further extend through a respective opening in the one or more plastic strips. The conductive strip may be separate from the one or more plastic strips, and the dielectric fasteners may hold the conductive strip firmly against the one or more plastic strips. The dielectric fasteners and the one or more plastic strips may be formed of different materials or the same material. In some embodiments, a plastic cover strip may be provided on the conductive strip opposite the one or more plastic strips that is made from the same material as the one or more plastic strips.

A maximum width of the one or more plastic strips may exceed a maximum width of the conductive strip. This may increase the amount of RF energy that travels through the plastic material (as opposed to air), which may help further reduce the physical length of the RF transmission line that is necessary to provide a specified electrical length.

The one or more plastic strips may be formed, for example, of a plastic material having a dielectric constant of at least 2.0 or, in some cases, at least 2.5 or at least 3.0. The plastic material may have a dissipation factor at 1 GHz of less than 0.001 in some embodiments.

The RF transmission lines according to embodiments of the present invention may be particularly well-suited for use in filters such as filters that are used in cellular communication systems. Such filters are often used on high power RF signals that may be hundreds of watts or more. Due to power handling limitations, air-insulated microstrip transmission lines are often used in these filters. However, air-insulated microstrip transmission lines tend to have high impedances due to the air dielectric, and hence the microstrip transmission lines may have increased length (compared to, for example, a printed circuit board-based microstrip transmission line) in order to exhibit a desired impedance value. In many cases, the increased length for the microstrip transmission line may require an increase in the physical size of the filter and/or using conductive strips that bend in the horizontal and/or vertical planes to increase the physical length of the transmission line. The RF transmission lines according to embodiments of the present invention may advantageously provide a desired electrical length with a transmission line structure that has a shorter physical length due to the provision of the high dielectric constant dielectric material between the conductive strip and the conductive ground plane. This may allow for smaller and/or less complex filter designs. Additionally, the low-loss high dielectric constant materials that are used to form the RF transmission lines according to embodiments of the present invention may also be used to form resonator caps that are disposed between the resonators and a cover of the filter. These resonator caps may advantageously increase the capacitive coupling between the resonators and the filter cover (which may comprise a ground plane for the filter) and/or to allow for increased gaps between the resonators and the filter cover, which may be necessary for passing peak power handling specifications.

Embodiments of the present invention will now be described in further detail with reference to the attached figures.

A number of properties of an RF transmission line may be important to the performance thereof. There are various trade-offs between some of the properties, and which properties are more important may vary depending upon the application in which the RF transmission line is used. A non-exhaustive list of the properties that may be important include cost, dielectric loss, radiative loss, physical size, impedance, electrical size and ease of fabrication.

In some applications, the physical length of an RF transmission line is set by the distance separating two circuit elements that are electrically connected to each other via the RF transmission line. In other applications, however, the physical length of an RF transmission line may be based on a required electrical length. For example, in some applications, it may be important that an RF transmission line be some fraction (e.g., ¼, ½, 1, etc.) of the wavelength corresponding to the center frequency of the RF signals that are to be transmitted over the RF transmission line. The length of an RF transmission line in terms of the number of wavelengths of an RF signal that will fit within the RF transmission line is referred to as the electrical length of the RF transmission line. The relationship between the physical length and the electrical length of an RF transmission line is a function of the effective dielectric constant of the RF transmission line.

The fields that are generated when an RF signal is transmitted over a microstrip transmission line extend into the dielectric substrate of the microstrip structure and also extend into the air above the microstrip structure. As such, the effective dielectric constant of a microstrip transmission line is not only a function of the dielectric constant of the dielectric substrate, but also must take into account the percentage of the fields that flow in as opposed to above the microstrip structure. The effective dielectric constant $\varepsilon_e$ of a microstrip transmission line that consists of a conductive strip having a width W that is disposed above a wide ground plane and separated from the ground plane by a dielectric substrate having a thickness H and a dielectric constant $\varepsilon_r$, and for (W/H)≥1, may be approximated as:

$$\varepsilon_e = \frac{\varepsilon_r + 1}{2} + \frac{\varepsilon_r - 1}{2}\left(1 + 12\left(\frac{H}{W}\right)\right)^{-\frac{1}{2}} \quad (1)$$

This approximation does not take a number of variables into account, such as the thickness of the conductive strip, but is still useful for explaining the general concept. The physical length of a microstrip transmission line that corresponds to a single wavelength of an RF signal may be determined as follows:

$$\lambda = c/[f\sqrt{\varepsilon_e}] \quad (2)$$

where c is the speed of light and f is the frequency of the RF signal. Thus, the higher the effective dielectric constant $\varepsilon_e$, the shorter the physical length of a microstrip transmission line that is required to have a specified electrical length (e.g., an electrical length of one wavelength).

FIG. 1 is a perspective view of a conventional air-insulated microstrip transmission line 100. As shown in FIG. 1, the conventional air-insulator microstrip RF transmission line 100 includes a ground plane 110, a conductive strip 120, and a plurality of dielectric spacers 130. The conductive strip 120 is mounted at a desired distance above the ground plane 110. The dielectric spacers 130 are used to hold the conductive strip 120 in place to the ground plane 110 and to maintain the conductive strip 120 at a consistent distance above the ground plane 110. In the depicted embodiment, a first end of the microstrip RF transmission line 100 connects to a first connector 150, and the second end of the microstrip RF transmission line 100 connects to a second connector 152. The ground plane 110 may comprise a metal structure having a generally planar upper surface. In some embodiments, the ground plane 110 may be a housing of an RF device such as, for example, an RF filter. The conductive strip 120 may comprise, for example, a metal (e.g., copper) strip having a desired thickness for handling the current levels that the RF transmission line 100 is expected to support. A width of the conductive strip 120 may be selected based on, for example, impedance matching considerations.

Each dielectric spacer 130 may comprise, for example, a plastic screw 132 and an associated plastic washer 134. In an example embodiment, the plastic screws 132 and washers 134 may each be implemented using polyetheretherketone ("PEEK") material. The ground plane 110 and the conductive strip 120 may each include a plurality of spaced-apart openings (not visible in FIG. 1), with each opening in the ground plane 110 aligned with a corresponding one of the openings in the conductive strip 120. Each dielectric washer 134 may be positioned between the ground plane 110 and conductive strip 120 and aligned with the respective openings therein. The dielectric screws 132 are inserted through each respective opening in the conductive strip 120, a respective one of the dielectric washers 134, and through each respective opening in the ground plane 110. The dielectric screws 132 may be threaded into the respective openings in the ground plane 110 or may be threaded into a plastic nut (not shown) that is provided on the opposite side of the ground plane 110. The dielectric screws 132 and washers 134 may thus be used to mount the conductive strip 120 above the ground plane 110 and to maintain the conductive strip 120 at a consistent distance above the ground plane 110. In the depicted embodiment, the air gap between the conductive strip 120 and the ground plane 110 is 2.0 mm, but any appropriate-sized air gap may be used based on impedance match and loss considerations, among others. The openings in the ground plane 110 may or may not extend all the way through the ground plane 110, and may or may not be threaded openings.

The effective dielectric constant of the air-insulated microstrip transmission line 100 will be a combination of the dielectric constant of air (dielectric constant=1) and the dielectric constant of the dielectric spacers 130. Since the vast majority of the transmission line 100 has an air dielectric, the effective dielectric constant of the microstrip transmission line 100 will be close to 1. As shown from Equation (2) above, a microstrip transmission line having a dielectric constant close to 1 will have a relatively long physical length to obtain a desired electrical length. Replacing an air-insulated microstrip transmission line with a printed circuit board-based microstrip transmission line may reduce the physical length of the transmission line, but may result in a number of other problems, as discussed above.

Figure 2:
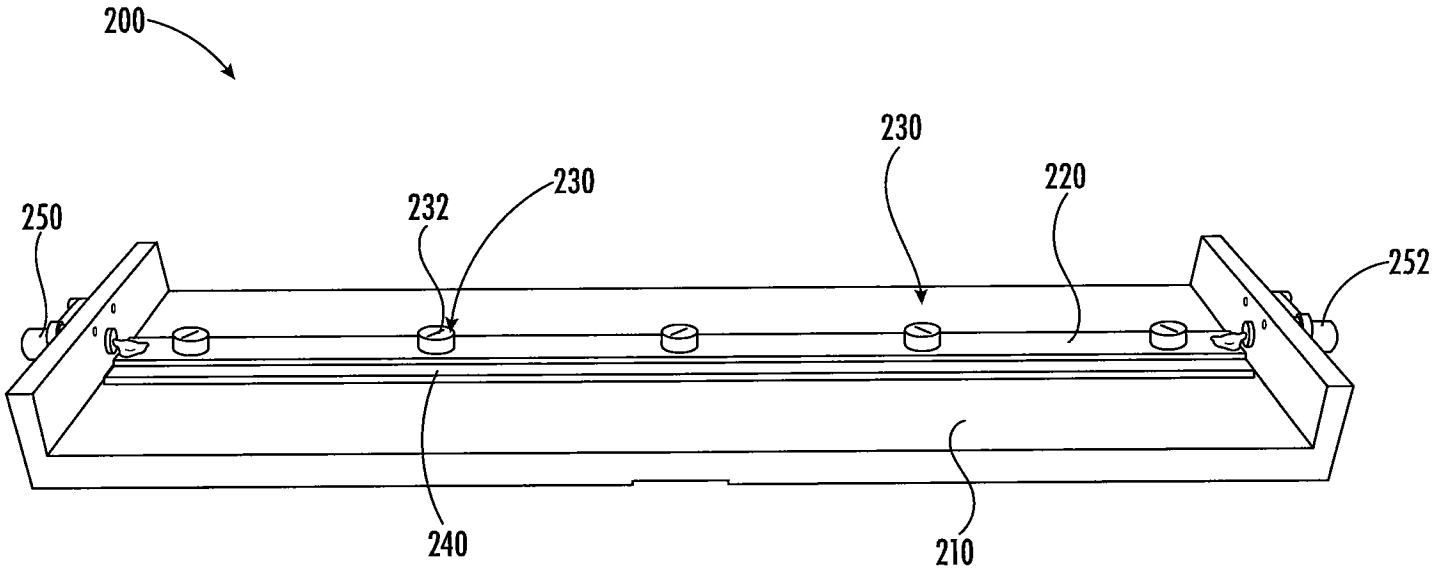
FIG. 2 is a perspective view of a microstrip transmission line according to embodiments of the present invention.

FIG. 2 is a perspective view of a microstrip transmission line 200 according to embodiments of the present invention. As can be seen, the microstrip transmission line 200 is similar to the conventional microstrip transmission line 100, but further includes a plastic strip that is disposed between the ground plane and conductive strip of the microstrip transmission line 200.

As shown in FIG. 2, the microstrip transmission line 200 includes a ground plane 210, a conductive strip 220, a plurality of dielectric fasteners 230 and a plastic strip 240 that is disposed between the ground plane 210 and conductive strip 220. The conductive strip 220 is mounted at a desired distance above the ground plane 210. The plastic strip 240 may be used to maintain the conductive strip 220 at a consistent distance above the ground plane 210. The dielectric fasteners 230 may be used to hold the conductive strip 220 in place on the plastic strip 240 and to mount the conductive strip 220 and the plastic strip 240 above the ground plane 210. In the depicted embodiment, a first end of the microstrip transmission line 200 connects to a first connector 250, and the second end of the microstrip transmission line 200 connects to a second connector 252. The ground plane 210 may comprise a metal structure having a generally planar upper surface. In some embodiments, the ground plane 210 may be a housing of an RF device such as, for example, an RF filter. The conductive strip 220 may comprise, for example, a metal (e.g., copper) strip having a desired thickness for handling the current levels that the RF transmission line 200 is expected to support. A width of the conductive strip 220 may be selected based on, for example, impedance matching considerations. The thickness of the conductive strip 220 may be selected based on a variety of considerations, including cost, weight, signal loss and/or the impedance match of the RF transmission line to adjacent structures such as connectors, cables or the like. Typically, cost and weight considerations may favor reduced thicknesses for the conductive strip 220, while impedance match and signal loss considerations tend to favor increased thickness.

The plastic strip 240 may comprise a unitary plastic strip (as shown) or a series of plastic strips. The plastic strip 240 may extend underneath all or substantially all of the conductive strip 220 in some embodiments. In other embodiments, the plastic strip 240 may only extend under a portion of the conductive strip 220. In some embodiments, the plastic strip 240 may extend underneath the conductive strip 220 for at least half the length of the conductive strip 220. In other embodiments, the plastic strip 240 may extend underneath the conductive strip 220 for at least three-quarters the length of the conductive strip 220. In still further embodiments, the plastic strip 240 may extend underneath the conductive strip 220 for at least ninety percent the length of the conductive strip 220.

The plastic strip 240 may be formed of a material having relatively low dielectric loss and a relatively high dielectric constant. For example, in some embodiments, the plastic strip 240 may be formed of PrePerm® thermoplastic material. Preperm® plastic materials are available from Premix Oy of Schaflund, Germany and exhibit low dielectric losses while providing high dielectric constants. For example, materials are available having dielectric constants in the range of 2.55 to 10.0 that have very low dielectric losses. For example, the dissipation factor for these materials may be less than 0.001, which correlates to very low dielectric losses. In some cases, the dissipation factor may be as low as 0.0004 and are in the range of 00005 to 0.0008 for a wide range of dielectric constants. These materials also have good mechanical properties and provide suitable performance over a wide temperature variation.

The microstrip transmission line 200 includes dielectric fasteners 230 as opposed to the dielectric spacers 130 of microstrip transmission line 100. The term "dielectric fastener" is used to describe the elements 230 in FIG. 2 because the plastic strip 240 may be used to space the conductive strip 220 apart from the conductive ground plane 210, and hence the primary (or only) purpose of the dielectric fasteners 230 may be to mount the conductive strip 220 and the plastic strip 240 above the conductive ground plane 210.

Each dielectric fastener 230 may comprise, for example, a plastic screw 232 (where the term "screw" is used broadly to encompass bolts, other threaded fasteners and the like). In an example embodiment, the plastic screws 232 may be implemented using PEEK material. In other embodiments, the plastic screws 232 may be implemented using PrePerm® material. Other materials may also be used. The ground plane 210, the conductive strip 220 and the plastic strip 240 may each include a plurality of spaced-apart openings (not visible in FIG. 2), with each opening in the ground plane 210 aligned with a corresponding one of the openings in the conductive strip 220 and a corresponding one of the openings in the plastic strip 240. Each dielectric screw 232 may be inserted through a respective opening in the conductive strip 220, a respective opening in the plastic strip 240 and a respective opening in the ground plane 210. The dielectric screws 232 may be threaded into the respective openings in the ground plane 210 or may be threaded into a plastic nut (not shown) that is provided on the opposite side of the ground plane 210. The dielectric screws 232 may thus be used to mount the conductive strip 220 and the plastic strips above the ground plane 210 while the plastic strip 240 may be used to maintain the conductive strip 220 at a consistent distance above the ground plane 210, and may be used to increase the effective dielectric constant of the microstrip transmission line. While the dielectric fasteners 230 are implemented as dielectric screws 232 in the depicted embodiment, it will be appreciated that a wide variety of other dielectric fasteners 230 may be used. For example, in other embodiments, dielectric spring clips, bolts, rivets, pins, latches or other similar structures may be mounted in the conductive ground plane 210 (or elsewhere) that are configured to spring bias the conductive strip 220 and the one or more plastic strips 240 against the conductive ground plane 210.

Figure 3:
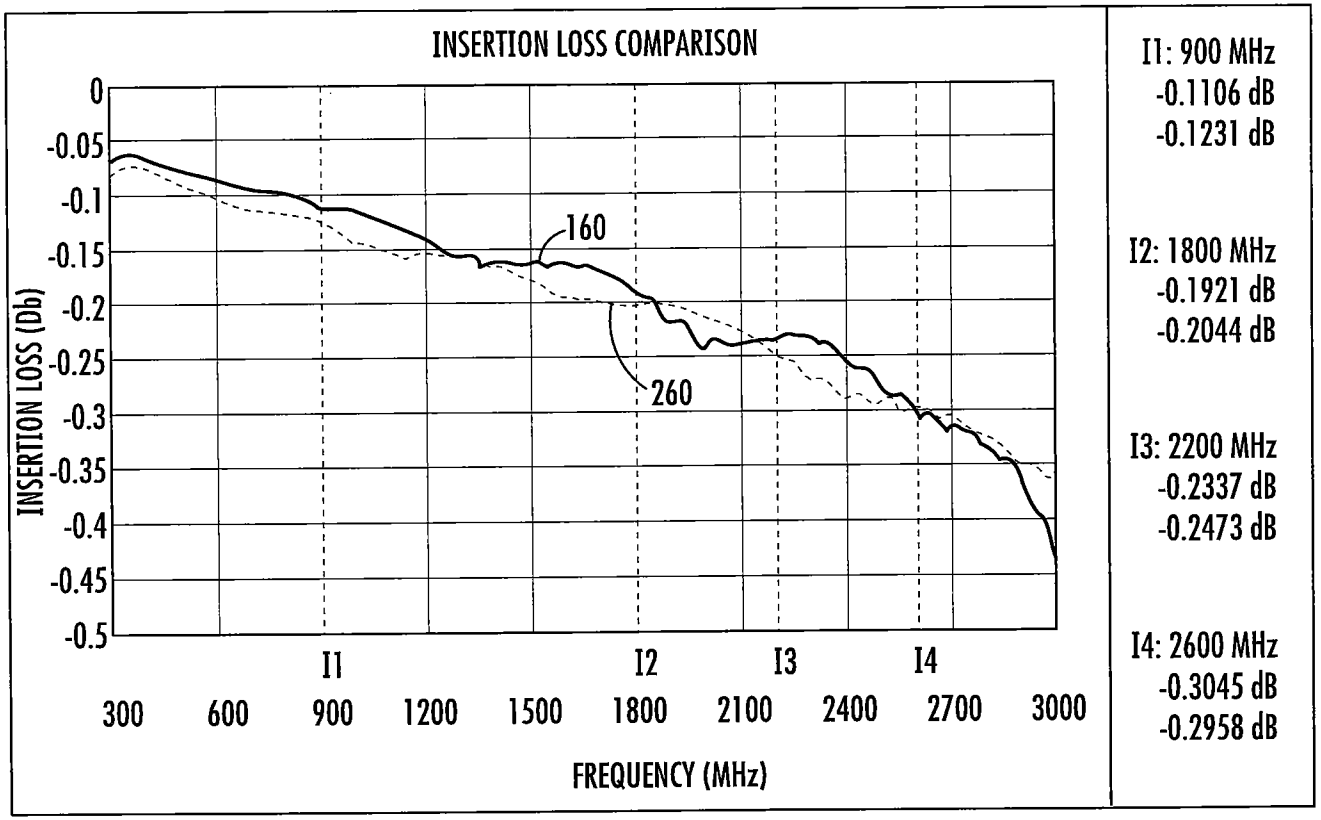
FIG. 3 is a graph comparing the insertion loss performance of the microstrip transmission lines of FIGS. 1 and 2.

FIG. 3 is a graph comparing the insertion loss performance of the transmission lines of FIGS. 1 and 2. Curve 160 in FIG. 3 represents the insertion loss for the air-insulated microstrip transmission line 100, while curve 260 in FIG. 3 represents the insertion loss for the microstrip transmission line 200 according to embodiments of the present invention. As shown in FIG. 3, the insertion loss for each transmission line 100, 200 generally increases with increasing frequency. As can be seen by comparing the two curves 160, 260, the insertion loss performance is substantially equal, with variation being less than about 0.025 dB, and with the insertion loss for transmission line 200 being lower than the insertion loss for transmission line 100 over a portion of the frequency range.

Figure 4:
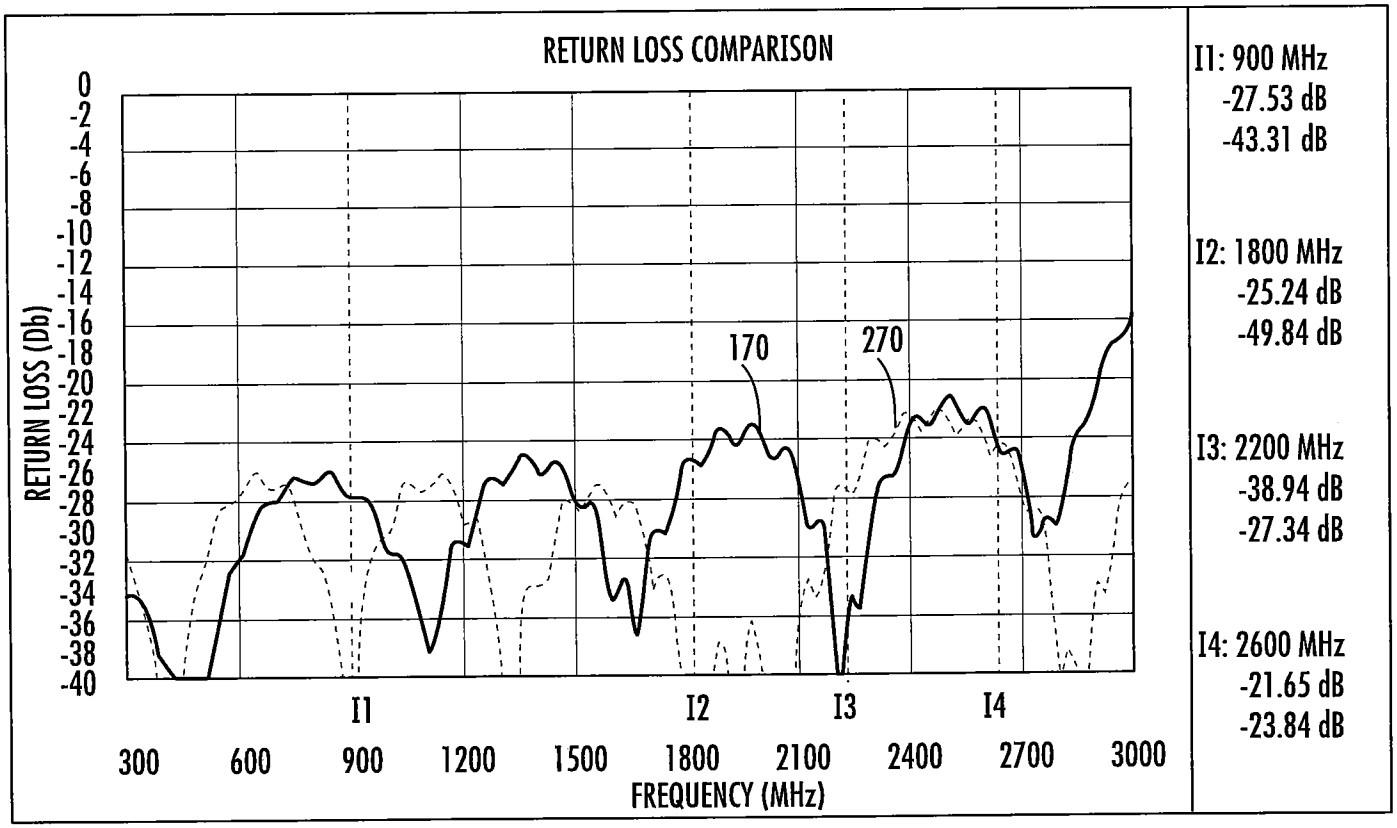
FIG. 4 is a graph comparing the return loss performance of the microstrip transmission lines of FIGS. 1 and 2.

FIG. 4 is a graph comparing the return loss performance of the transmission lines of FIGS. 1 and 2. In FIG. 4, curve 170 represents the return loss for the air-insulated microstrip transmission line 100, while curve 270 represents the return loss for the microstrip transmission line 200 according to embodiments of the present invention. As can be seen from FIG. 4, the return loss performance is also similar for each transmission line 100, 200, except that the particular frequencies where the peak return loss values occur are not aligned due to the difference in the electrical lengths of the two microstrip transmission lines 100, 200. Notably, the peak return loss values in similar frequency ranges are nearly identical, showing that that the microstrip transmission lines 100, 200 have very comparable return loss performance.

In the tests used to generate the graphs of FIGS. 3 and 4, the same test jig was used for both transmission line implementations, so the physical length of the two transmission lines was the same. The effective dielectric constant of the microstrip transmission line 200, which was formed using PrePerm® L300 that has a dielectric constant of 3.0, was about 2.4, which is more than twice the effective dielectric constant of the microstrip transmission line 100.

Figure 5:
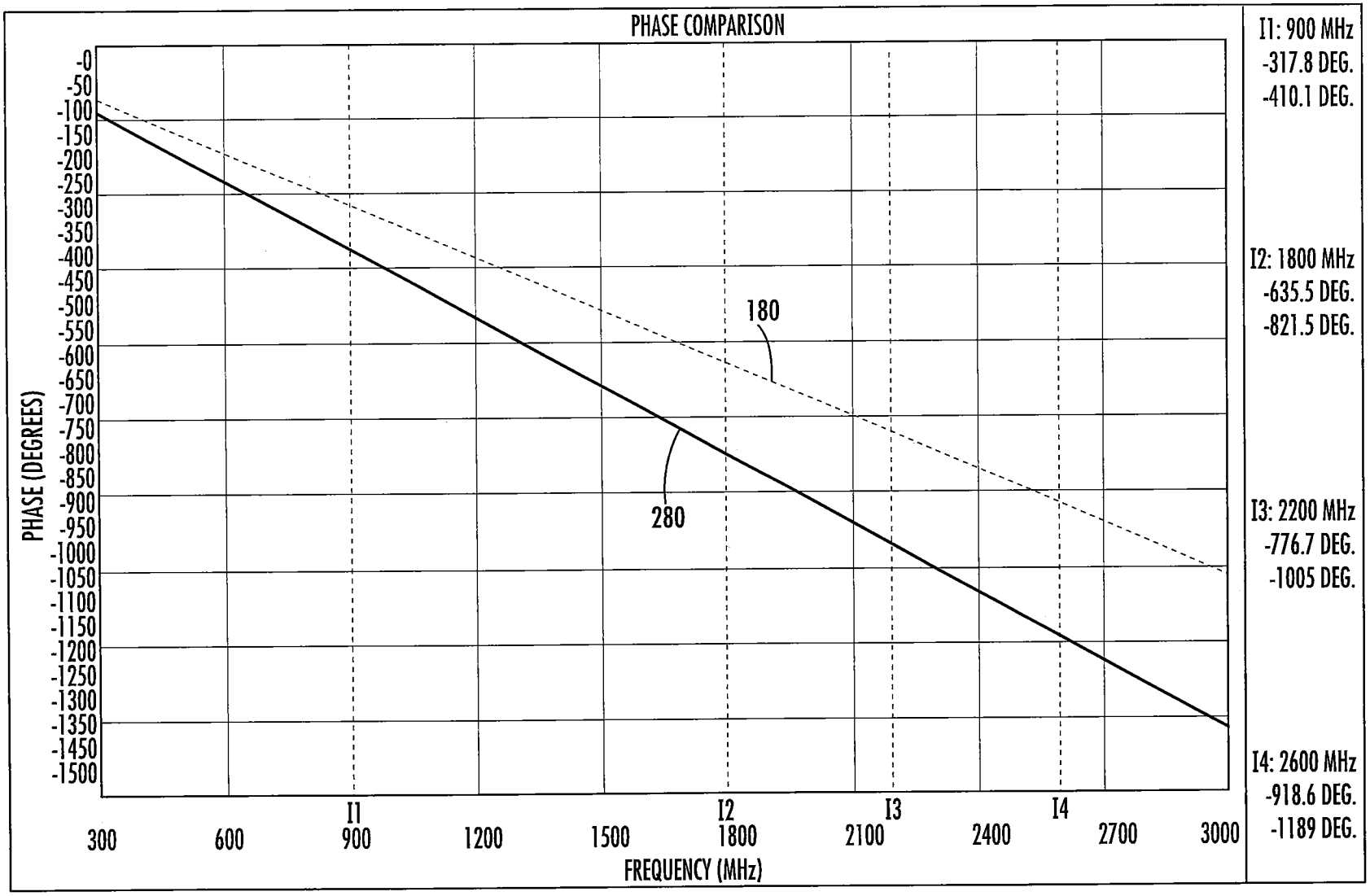
FIG. 5 is a graph comparing the phase change as a function of frequency for RF signals traversing the microstrip transmission lines of FIGS. 1 and 2.

FIG. 5 is a graph illustrating the phase change that occurs for RF signals traversing the microstrip transmission lines 100 and 200 of FIGS. 1-2 as a function of the frequency of the RF signal. In particular, curve 180 illustrates the phase change for RF signals traversing microstrip transmission line 100, while curve 280 illustrates the phase change for RF signals traversing microstrip transmission line 200. Comparisons of the phase changes are provided for four different frequencies, namely 900 MHz, 1800 MHz, 2200 MHz and 2600 MHz. As can be seen in FIG. 5, the ratio of the phase change for microstrip transmission line 100 to microstrip transmission line 200 consistently remains at a value of about 1.29 over the full frequency range shown in FIG. 5. This shows that the electrical length of microstrip transmission line 200 is about 1.29 times longer than the electrical length of microstrip transmission line 100. Thus, if a particular application requires a transmission line having a length of one wavelength at a particular frequency, a transmission line having the design of transmission line 100 that has such a length would have a physical length that is 1.29 times longer than a transmission line 200 that has the specified length of one wavelength at the particular frequency. Thus, the microstrip transmission line 200 can provide comparable performance to a conventional air-insulated microstrip transmission line 100, but may have a significantly reduced physical dimensions to provide the same electrical length.

Figure 6:
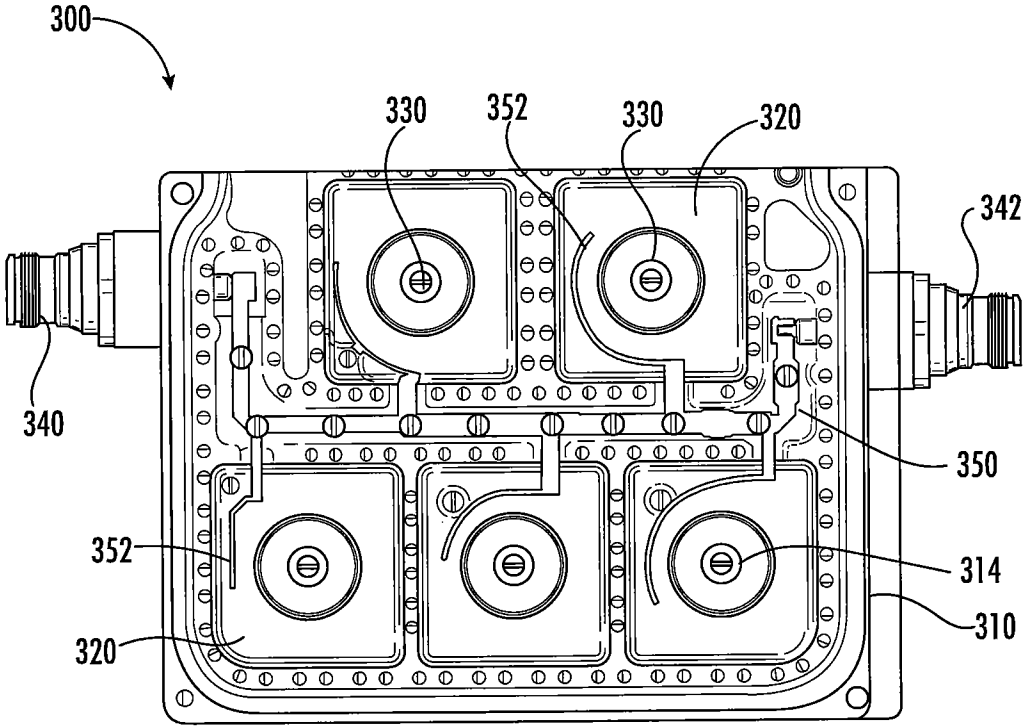
FIG. 6 is a schematic plan view of a filter that includes a microstrip transmission line according to embodiments of the present invention.

Pursuant to further embodiments of the present invention, RF filters are provided that include RF transmission lines according to embodiments of the present invention. These filters may also include resonator caps formed of low loss, high dielectric constant plastic materials that may increase the capacitance between the resonators and, for example, a cover of the filter, and which may also allow for larger gaps between the resonators and the cover, which may facilitate passing peak power tests. FIG. 6 is a schematic plan view of a filter 300 that includes an RF transmission line according to embodiments of the present invention that illustrates one example of such a filter. While the filter 300 illustrated in FIG. 6 is a rejection filter, it will be appreciated that low pass filters and bandpass filters may also be provided according to embodiments of the invention that include RF transmission lines having low-loss, high dielectric constant dielectric strips and/or the resonator caps that are discussed below.

As shown in FIG. 6, the filter 300 includes a housing 310 that has a plurality of cavities 320 formed therein. The housing 310 has an open top and a separate cover (not shown) may be provided that is installed to cover the open top of the housing 310. A resonator 330 may be disposed in each cavity. The filter 300 may include first and second connectors 340, 342 that extend through the housing 310. An RF transmission line 350 may connect the first connector 340 to the second connector 342. The RF transmission line 350 may include conductive stubs 352 that extend into the cavities 320. Each stub 352 may be configured to capacitively couple with a respective one of the resonators 330.

In various filter designs, the distance between the conductive stubs 352 must be a preselected fraction of a wavelength. In some cases, this may result in a filter design where the length of the filter housing is driven by the length of the RF transmission line 350 as opposed to other factors such as the sizes of the cavities 320. In such designs, the filter housing 310 may be made longer to accommodate the necessary length for the RF transmission line 350 and/or more complex RF transmission lines 350 may be used that have segments extending in multiple different planes (e.g., the RF transmission line 350 would have curves in the horizontal and/or vertical planes) in order to obtain an increased physical length without increasing the length of the filter housing 310.

As discussed above, the RF transmission lines 200 according to embodiments of the present invention may include one or more low-loss, high dielectric constant plastic strips between the conductive strip 220 and the ground plane 210. As a result, the RF transmission lines 200 may have reduced physical size as compared to conventional air-insulated microstrip transmission lines. In an example embodiment, the length and width of the microstrip transmission line may each be reduced by nearly one-third using the techniques described herein, without any noticeable impact on performance. Thus, the RF transmission lines according to embodiments of the present invention may allow for more compact and lighter weight filter designs.

Additionally, the increased effective dielectric constant of the RF transmission lines according to embodiments of the present invention allows providing a lower impedance microstrip transmission line having the same size as a conventional air-insulated microstrip transmission line or, alternatively, providing a smaller microstrip transmission line that has the same impedance as the larger conventional air-insulated microstrip transmission line.

Figure 7:
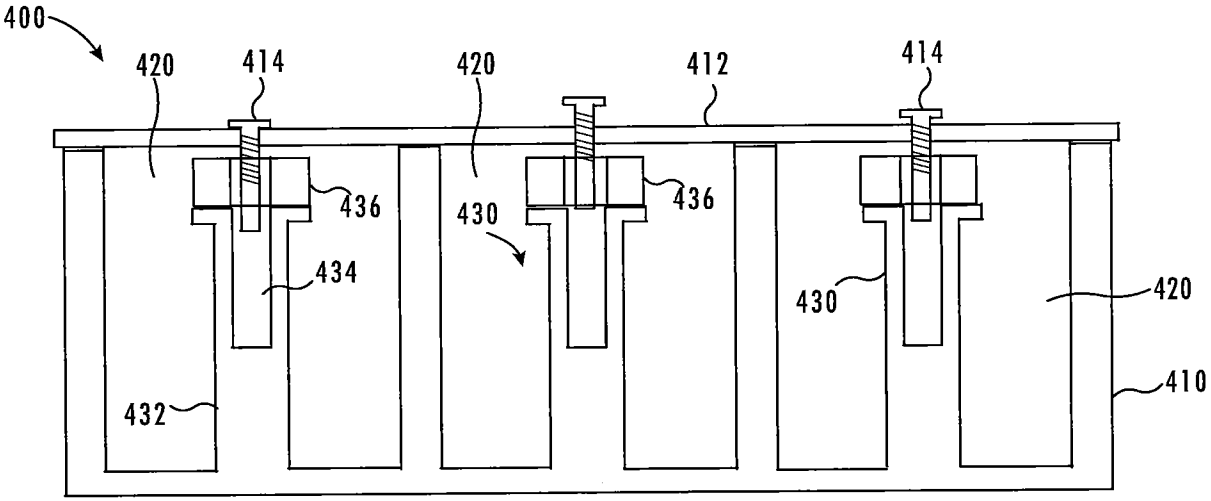
FIG. 7 is a schematic cross-sectional view of a filter that includes low loss dielectric material on top of the resonators thereof according to embodiments of the present invention.

FIG. 7 is a schematic cross-sectional view of a filter 400 according to further embodiments of the present invention that uses a low loss dielectric material to increase the coupling between the tops of the resonators and the cover of the filter. As shown in FIG. 7, the filter 400 includes a housing 410 that has a plurality of cavities 420 formed therein. The housing 410 has an open top and a separate cover 412 covers the open top of the housing 410. A resonator 430 is disposed in each cavity 420. As shown in FIG. 7, each resonator 430 may comprise a cylindrical stalk 432 that has a cylindrical opening 434 in a top portion thereof. Tuning screws 414 or other tuning elements may be provided that extend through the cover 412 of the filter 400. The extent to which each tuning screw 414 extends into the cylindrical opening 434 of its associated resonator 430 may be used to tune properties of the filter 400, such as the frequency ranges where the filter passes and/or rejects RF signals. As is further shown in FIG. 7, each resonator 430 may also include an annular cap 436 that is disposed between the top of the resonator stalk 432 and the filter cover 412. The annular caps 436 may increase the capacitive coupling between the resonator stalks 432 and the filter cover 412, which may improve the performance of the filter. Additionally, since the capacitive coupling may be significantly increased, it may be possible to increase the overall gap between each resonator 430 and the filter cover 412. This increased gap may facilitate passing a peak power test for the filter 400.

Figure 8:
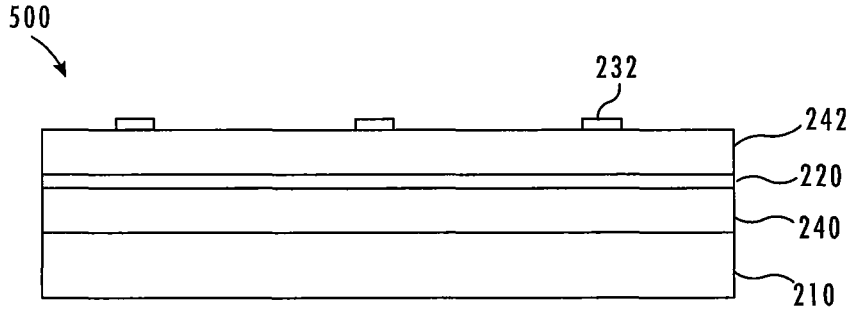
FIG. 8 is a schematic side view of a microstrip transmission line according to further embodiments of the present invention that includes a low-loss, high dielectric cover strip.

FIG. 8 is a schematic side view of a microstrip transmission line 500 according to further embodiments of the present invention that includes a low-loss, high dielectric cover strip. As shown in FIG. 8, the microstrip transmission line 500 may be almost identical to the microstrip transmission line 200 that is discussed above with reference to FIG. 2, except that the microstrip transmission line 500 further includes a dielectric cover strip 242 that extends over the conductive strip 220. The dielectric cover strip 242 may be identical to the plastic strip 240 having, for example, the same length and width and may be formed of the same material as the plastic strip 240. As discussed above, the plastic strip 240, and hence the dielectric cover strip 242, may be formed of a low-loss, high dielectric constant material such as a PrePerm® plastic. The dielectric cover strip 242 may include a plurality of openings (not visible in the drawings) that are aligned with the openings in the plastic strip 240, and each dielectric fastener 230 may extend through the respective openings in the dielectric cover strip 242, the conductive strip 220, the plastic strip 240 and into an opening in the conductive ground plane 210. The dielectric cover strip 242 may help increase the effective dielectric constant of the microstrip RF transmission line 500.

Figure 9:
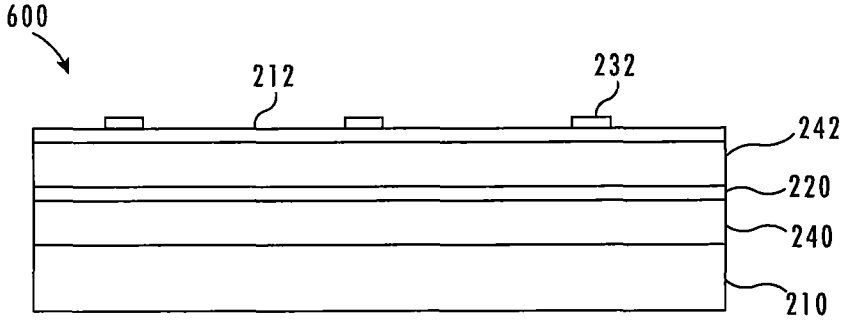
FIG. 9 is a schematic side view of a stripline transmission line according to still further embodiments of the present invention.

FIG. 9 is a schematic side view of a stripline transmission line 600 according to still further embodiments of the present invention. As shown in FIG. 9, the stripline transmission line 600 may be almost identical to the microstrip transmission line 500 that is discussed above with reference to FIG. 8, except that the stripline transmission line 600 further includes a second ground plane 212 that is formed on the dielectric cover strip 242 opposite the conductive strip 220. The addition of the second ground plane 212 acts to substantially enclose the conductive strip 220 between a pair of ground planes, which serves to constrain the RF energy and reduce radiative losses. The RF fields will primarily travel in the low-loss, high dielectric constant plastic strips 240, 242 that are disposed on the top and bottom surfaces of the conductive strip 220. This arrangement further increases the effective dielectric constant of the transmission line 600. In an example embodiment, the second ground plane 212 may include a plurality of openings, and each dielectric fastener 230 may extend through the respective openings in the second ground plane 212, the dielectric cover strip 242, the conductive strip 220, the plastic strip 240 and into an opening in the conductive ground plane 210. The dielectric cap layer may help increase the effective dielectric constant of the microstrip RF transmission line 500.

The RF transmission lines according to embodiments of the present invention may provide a number of advantages over conventional RF transmission lines. As discussed above, the RF transmission lines according to embodiments of the present invention may provide performance in terms of insertion loss, return loss, power handling capability and the like that is comparable to air-insulated microstrip transmission lines and that is superior to conventional printed circuit board-based microstrip transmission lines, while having physical dimensions that are substantially smaller (for the same electrical length) than the conventional air-insulated microstrip transmission lines. Moreover, the RF transmission lines according to embodiments of the present invention may be cheaper than comparable conventional air-insulated microstrip transmission lines as the cost savings associated with the reduction in physical size (which reduces the size of the ground plane and of the conductive strip) may more than offset the additional cost associated with providing a low-loss, high dielectric constant plastic material.

Moreover, in comparison to conventional printed circuit board-based microstrip transmission lines, the RF transmission lines according to embodiments of the present invention may exhibit lower dielectric losses and lower signal transmission losses. Additionally, because thicker conductive strips can be used, better impedance matches may be obtained in many cases to connectors that may be coupled to one or both ends of the RF transmission line, resulting in improved return loss performance, and the RF transmission lines according to embodiments of the present invention may exhibit good power handling capabilities. Additionally, since the conductive strip may be very smooth (i.e., almost no surface roughness), the RF transmission lines according to embodiments of the present invention may exhibit improved PIM performance as compared to conventional printed circuit board-based microstrip transmission lines.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A radio frequency ("RF") transmission line, comprising:

a conductive ground plane;

a conductive strip above the ground plane;

one or more plastic strips disposed between the conductive ground plane and the conductive strip, the one or more plastic strips having a combined length that is at least half a length of the conductive strip; and a plurality of dielectric fasteners that maintain the conductive strip at a predetermined distance above the conductive ground plane, wherein major surfaces of the respective one or more plastic strips extend in parallel to a major surface of the conductive strip.

2. The RF transmission line of claim 1, wherein the plurality of dielectric fasteners comprise dielectric screws.

3. The RF transmission line of claim 2, wherein each dielectric screw extends through a respective opening in the conductive strip into a respective opening in the conductive ground plane.

4. The RF transmission line of claim 1, wherein each dielectric fastener extends through a respective opening in the one or more plastic strips.

5. The RF transmission line of claim 1, wherein the conductive strip is separate from the one or more plastic strips, and wherein the plurality of dielectric fasteners capture the one or more plastic strips between the conductive strip and the conductive ground plane.

6. The RF transmission line of claim 1, wherein a distance between the conductive strip and the conductive ground plane is the same as thicknesses of the respective one or more plastic strips.

7. The RF transmission line of claim 1, further comprising a plastic cover strip that is on the conductive strip opposite the one or more plastic strips.

8. The RF transmission line of claim 1, wherein the one or more plastic strips are formed of a plastic material having a dielectric constant of at least 2.0.

9. The RF transmission line of claim 1, wherein the one or more plastic strips are formed of a plastic material having a dielectric constant of at least 2.5 and a dissipation factor at 1 GHz of less than 0.001.

10. The RF transmission line of claim 1, further comprising:

a filter housing;

a first connector that extends through the filter housing;

a second connector that extends through the filter housing, wherein the RF transmission line electrically connects the first connector to the second connector, and wherein the conductive ground plane comprises a surface of the filter housing.

11. The RF transmission line of claim 10, further comprising a plurality of resonators within the filter housing, wherein a plastic material having a dielectric constant of at least 2.5 is provided between top portions of at least one of the plurality of resonators and a filter cover that covers an opening in the filter housing.

12. A radio frequency ("RF") transmission line, comprising:

a conductive ground plane;

a conductive strip that extends above the ground plane, where a length of the conductive strip in a first direction is greater than a width of the conductive strip in a second direction, and wherein the width of the conductive strip in the second direction is greater than a thickness of the conductive strip in a third direction, the first, second and third directions being perpendicular to each other;

a plastic strip disposed between the conductive ground plane and the conductive strip, the plastic strip having a width in the second direction that is greater than the width of the conductive strip, the plastic strip being separate from the conductive strip, wherein the plastic strip is formed of a plastic material having a dielectric constant of at least 2.5 and a dissipation factor at 1 GHz of less than 0.001.

13. The RF transmission line of claim 12, further comprising a plurality of dielectric fasteners that maintain the conductive strip at a predetermined distance above the conductive ground plane.

14. The RF transmission line of claim 13, wherein the plurality of dielectric fasteners comprise dielectric screws.

15. The RF transmission line of claim 14, wherein each dielectric screw extends through a respective opening in the conductive strip into a respective opening in the conductive ground plane.

16. The RF transmission line of claim 15, wherein each dielectric screw further extends through a respective opening in the plastic strip.

17. The RF transmission line of claim 12, further comprising a plastic cover strip that is on the conductive strip opposite the plastic strip and a second ground plane on the plastic cover strip opposite the conductive strip to provide a stripline transmission structure.

18. The RF transmission line of claim 17, further comprising a plurality of dielectric fasteners, where each dielectric fastener extends through the second ground plane, the plastic cover strip, the conductive strip, the plastic strip and into the conductive ground plane.

19. A radio frequency ("RF") filter, comprising:

a filter housing having a top opening;

a filter cover that is dimensioned to cover the top opening;

a first connector that extends through a first connector opening in the filter housing;

a second connector that extends through a second connector opening in the filter housing;

a plurality of resonators within the filter housing;

an RF transmission line disposed on an RF transmission path that extends from the first connector to the second connector, wherein the RF transmission line comprises:

a conductive ground plane;

a conductive strip disposed above the conductive ground plane;

one or more plastic strips disposed between the conductive ground plane and the conductive strip, the one or more plastic strips having a combined length that is at least half a length of the conductive strip; and a plurality of dielectric fasteners that maintain the conductive strip at a predetermined distance above the conductive ground plane and that capture the one or more plastic strips between the ground plane and the conductive strip, wherein major surfaces of the respective one or more plastic strips extend in parallel to a major surface of the conductive strip.

20. The RF filter of claim 19, wherein at least one of the plurality of dielectric fasteners extends through a respective opening in the conductive strip and through a respective opening in the one or more plastic strips into a respective opening in the conductive ground plane.

21. The RF filter of claim 19, wherein the plurality of dielectric fasteners comprise dielectric screws.

22. The RF filter of claim 19, wherein the conductive ground plane comprises a floor of the filter housing.

23. The RF filter of claim 19, wherein a maximum width of the one or more plastic strips exceeds a maximum width of the conductive strip.

* * * * *